US010827868B1

(12) United States Patent
Wheaton et al.

(10) Patent No.: US 10,827,868 B1
(45) Date of Patent: Nov. 10, 2020

(54) TAMPER RESISTANT PARCEL DELIVERY BOX

(71) Applicants: Keith Wheaton, Winter Garden, FL (US); Steven A. Amato, Orlando, FL (US)

(72) Inventors: Keith Wheaton, Winter Garden, FL (US); Steven A. Amato, Orlando, FL (US)

( * ) Notice: Subject to any disclaimer, the term of this patent is extended or adjusted under 35 U.S.C. 154(b) by 14 days.

(21) Appl. No.: 16/408,856

(22) Filed: May 10, 2019

(51) Int. Cl.
*A47G 29/14* (2006.01)
*B65D 55/14* (2006.01)
*A47G 29/20* (2006.01)

(52) U.S. Cl.
CPC ..... *A47G 29/141* (2013.01); *A47G 29/20* (2013.01); *B65D 55/14* (2013.01)

(58) Field of Classification Search
CPC ..... A47G 29/20; A47G 29/141; B65D 55/14; E05B 65/0075; E05B 47/02; E05C 3/30; E05C 17/02; G07C 9/00912
USPC ..... 232/17, 19, 45; 70/63, 84, 161; 340/569
See application file for complete search history.

(56) References Cited

U.S. PATENT DOCUMENTS 2,181,289 A 5/1936 Wells
2,313,711 A 3/1943 Jacobi
2,511,253 A 6/1950 Fischer
3,964,280 A 6/1976 Kelton
4,991,416 A 2/1991 Resendez, Jr. et al.
5,308,126 A 5/1994 Weger, Jr. et al.
7,743,935 B2 6/2010 Maid
8,869,576 B2 10/2014 O'Leary et al.
9,630,757 B1 4/2017 Capous
10,131,478 B2 * 11/2018 Maser ..... E05B 65/5223
2010/0085148 A1 * 4/2010 Nesling ..... G07C 9/00912 340/5.73
2015/0108771 A1 4/2015 Barrett et al.
2015/0135782 A1 5/2015 Sadler et al.
2016/0060008 A1 * 3/2016 Farentinos ..... E05B 49/002 220/211
2018/0070753 A1 * 3/2018 Eveloff ..... G07C 9/00912
2019/0000255 A1 * 1/2019 Dehner ..... E05B 47/023
2019/0387910 A1 * 12/2019 Stoich ..... G07C 9/37
2020/0163480 A1 * 5/2020 Waisanen ..... E05C 17/085

* cited by examiner

*Primary Examiner* — William L Miller
(74) *Attorney, Agent, or Firm* — Allen, Dyer et al.

(57) ABSTRACT

A tamper resistant parcel delivery box includes a container configured to receive packages therein. A lid is secured over the container via a hinge and a locking interface is secured to the container and has a retractable deadbolt. The box also includes a locking bar having a first end and a second end, where the second end cooperates with the retractable deadbolt. A catch is secured to an underside of the lid to lock the first end of the locking bar to the lid when the deadbolt is extended to force the first end into the catch. In addition, the box includes a tamper prevention circuit configured to selectively prevent the locking interface from actuating the retractable deadbolt when the lid is open.

20 Claims, 6 Drawing Sheets

TAMPER RESISTANT PARCEL DELIVERY BOX

TECHNICAL FIELD

The present invention relates to the field of parcel delivery boxes, and, more particularly, to a tamper resistant parcel delivery box and related methods.

BACKGROUND

More people are purchasing products from online retailers that ship directly to the customer's home. Home delivery is not a new concept but this has also brought an increase in theft of parcels left unattended on doorsteps. News stories often include video captured by home security cameras that shows a delivery person dropping a parcel off at a home and later a thief running up and stealing the parcel. This type of theft is known as "porch pirates." While the vast majority of parcels are delivered without being stolen, it is still estimated that millions have had their parcels stolen from their homes before they could be opened.

Lock boxes are sometimes used for commercial properties or apartment complexes for delivery of parcels. One example of a lock box is set forth in U.S. Pat. No. 7,743,935 to Maid, which discloses a self-locking enclosure which provides an enclosure having a hingedly coupled lid that locks by operation of a latch which allows a first occurrence of the lid in the closed condition and subsequent operation of the lid to the open condition, and which locks upon the second occurrence of the lid in the closed condition.

Despite the existence of such configurations, further improvements in parcel lock boxes may be desirable in certain instances.

SUMMARY

A tamper resistant parcel delivery box is disclosed. The tamper resistant parcel delivery box includes a container having a top periphery edge and an interior volume configured to receive packages therein. The box also includes a hinge positioned along the top periphery edge of the container, a lid secured to the container via the hinge, and a locking interface secured to the container and having a retractable deadbolt.

In addition, the tamper resistant parcel delivery box includes a locking bar having a first end and a second end, where the second end cooperates with the retractable deadbolt. The box also includes a catch secured to an underside of the lid to lock the first end of the locking bar to the lid, and a tamper prevention circuit configured to selectively prevent the locking interface from actuating the retractable deadbolt when the lid is open.

The first end of the locking bar may have a notch and a beak extending over the notch to engage the catch, and a locking bar spring secured to the locking bar and biasing the locking bar in a first direction. The locking interface may have a touchpad and a keyhole in order to lock and unlock the lid.

A plunger rod may be secured to the container and having a first end positioned below the underside of the lid.

The tamper prevention circuit may comprise a micro switch or a magnetic switch, for example. The plunger rod is positioned to slide down towards the tamper prevention circuit in response to movement of the lid. The tamper prevention circuit is configured to prevent the locking interface from actuating the retractable deadbolt when the tamper prevention circuit is in an open circuit condition indicating the lid is open.

The locking bar may have a pivot pin at a midpoint in order for the locking bar to alternate between moving the first end in a first direction and the second end moving in an opposing second direction in a see-saw motion.

A power source may be coupled to the locking interface and the tamper prevention circuit. The container may also have a slot formed therein and configured to pass mail to the interior volume of the container. The lid may have a seat to support a weight of a person sitting thereon.

In another particular aspect, a method is disclosed of operating a tamper resistant parcel delivery box where the box includes a container, a hinge, a lid secured to the container via the hinge, a locking interface secured to the container and having a retractable deadbolt, a locking bar having a first end and a second end cooperating with the retractable deadbolt, a catch secured to an underside of the lid to lock the first end of the locking bar to the lid, and a tamper prevention circuit configured to selectively prevent the locking interface from actuating the retractable deadbolt when the lid is open.

The method includes receiving lock input from the locking interface, detecting if the lid is in a closed position, and using the tamper prevention circuit to selectively prevent the locking interface from actuating the retractable deadbolt based upon determining that the lid is in the open position.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

By way of background, as noted above lock boxes are sometimes used for commercial properties or apartment complexes for delivery of parcels. However, the use of a lock box at a home requires a unique key that has to be provided to the delivery person. In addition, there are many companies delivering parcels and not the same delivery person. Accordingly, providing unique keys to delivery companies for every home is not feasible and thus making the use of a lock box at a home is not feasible in most scenarios.

Another possible option is the use of an electronic code but again, similar to a key, the code must be shared with the delivery companies and persons. This likely will not be feasible and be unacceptably cumbersome for implementation in residential homes. Generally speaking, the present disclosure is directed to a delivery box that is not only convenient to use but also tamper resistant to would be thieves.

Figure 1:
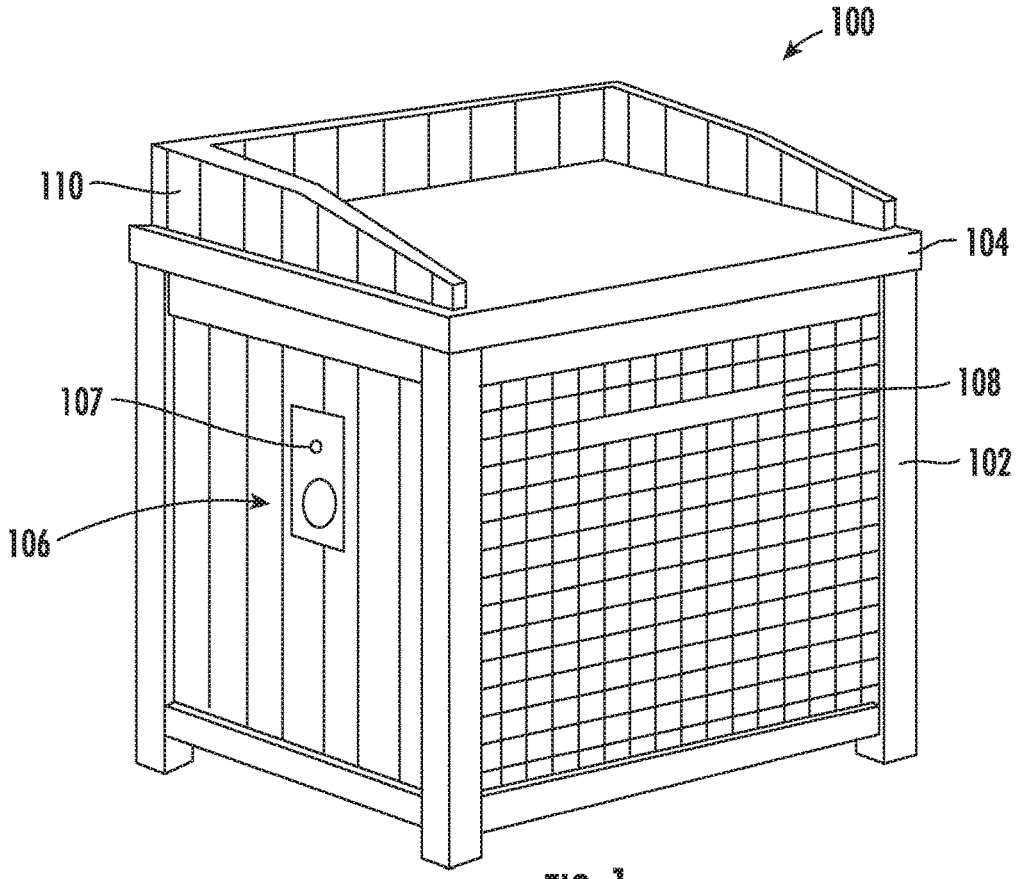
FIG. 1 is perspective view of a tamper resistant parcel delivery box in accordance with the present disclosure.
Figure 2:
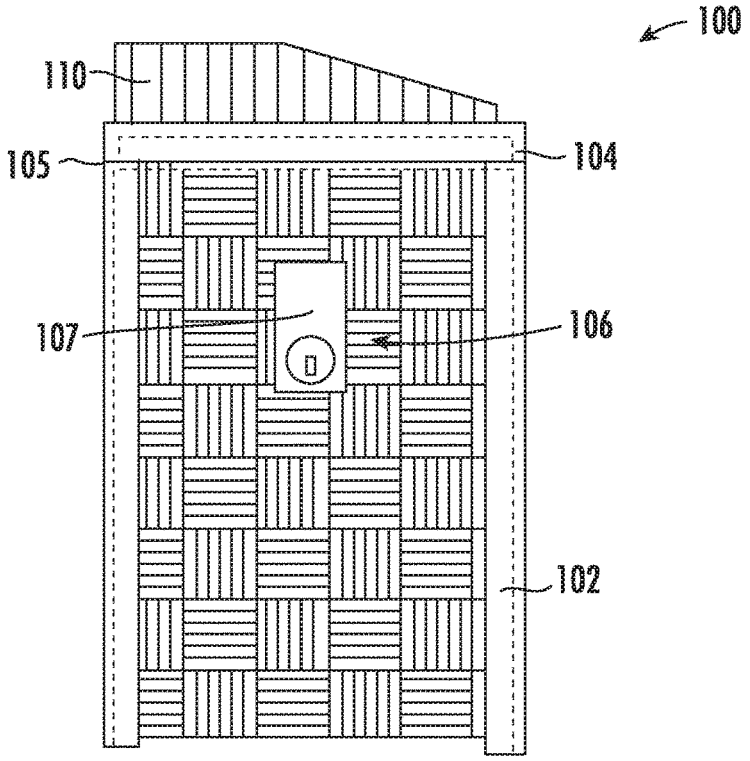
FIG. 2 is a left side elevational view of the tamper resistant parcel delivery box of FIG. 1.

Referring initially to FIGS. 1 and 2, a tamper resistant parcel delivery box (also referred to hereinafter as "box") in accordance with an aspect of the invention is illustrated and generally designated 100. The box 100 includes a container 102 that includes four sides and a bottom. The top of the container 102 is open. In particular, a lid 104 is secured over the top of the container 102. The lid 104 is configured to open and close over the top of the container 102 using a hinge 105.

The orientation of the box 100 and components correlates to a direction as a person stands in front of the box 100. For example, the hinge 105 is disposed on a side of the box 100. Accordingly, a locking interface 106 may be disposed on an opposing side from the hinge 105 and a mail slot 108 may be disposed on a front of the container 102 of the box 100 as shown in FIG. 1. The locking interface 106 may include a touchpad 107 having numbers for entering a code. Once the code is entered, the locking mechanism 106 is configured to unlock the lid 104 when it is locked over the container 102 as described in more detail below.

The lid 104 may include a seat 110 that serves to increase the utility of the box 100 and to conceal the purpose of the box 100 to would be thieves. The lid 104 can support the weight of a person sitting on the seat 110. The box 100 may also have decorative graphics or texture to increase the aesthetic appeal of the box 100.

Figure 3:
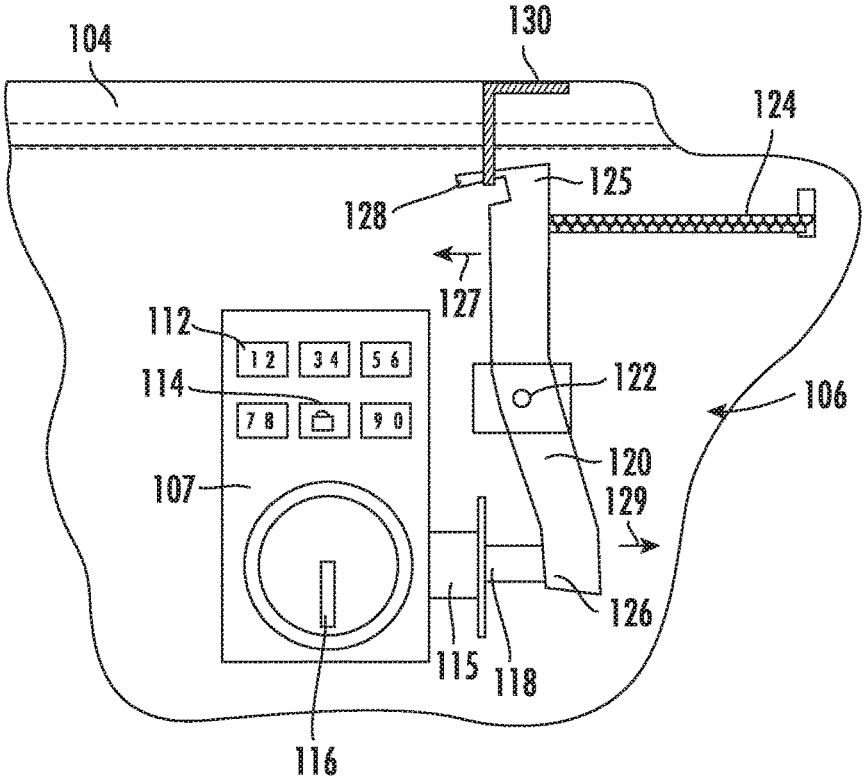
FIG. 3 is a cutaway view of a locking interface with a locking bar in a locked position.

Referring now to FIG. 3, a cutaway view of the locking interface 106 is illustrated. The locking interface 106 includes a touchpad 107 that is programmed to cause a deadbolt 118 to either extend from a housing 115 or to retract within the housing 118. For example, in FIG. 3, the deadbolt 118 is extended from the housing 115 indicating a locked position. The locking interface 106 includes a locking bar 120 that has a first end 125 and a second end 126, and secured about a pivot 122 in a middle portion of the locking bar 120. Accordingly, the locking bar 120 moves in a back and forth motion (i.e. see-saw motion) as one end is pushed in a first direction, an opposing end moves in an opposite second direction.

For example, when the deadbolt 118 is extended as in FIG. 3, the deadbolt 118 pushes against the second end 126 of the locking bar 120 causing it to move in a first direction 129. In response, this causes the first end 125 to move in the opposite second direction 127 into catch 130 so that the lid 104 is locked over the container 102.

Figure 4:
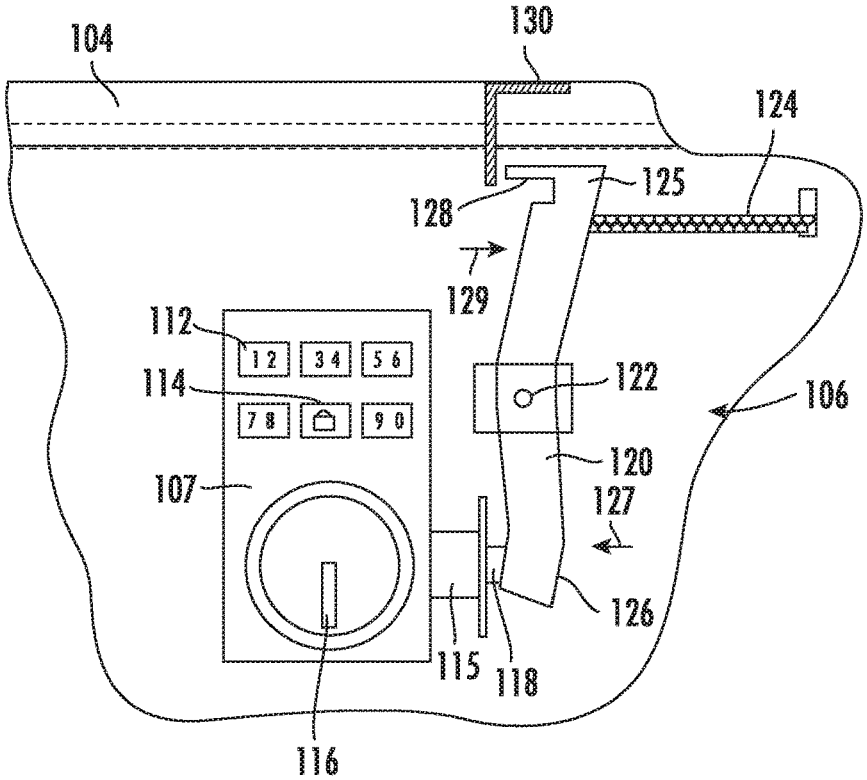
FIG. 4 is a cutaway view of the locking interface with the locking bar in an unlocked position.

Referring now to FIG. 4, the locking interface 106 is shown in the unlocked position. The deadbolt 118 is retracted within the housing 115. The locking bar spring 124 is biased so that when the deadbolt 118 is retracted, the second end 126 of the locking bar 120 moves in the same direction as the deadbolt 118. In a particular aspect the deadbolt 118 may be connected to the second end 126 thereby eliminating the locking bar spring 124. As the second end 125 moves in the second direction 127, the first end 125 moves in the first direction 129 and releases from the catch 130.

The locking interface 106 may be operated by a user using a touchpad 107. For example, in order to unlock the lid 104, the user may enter a unique code using buttons 112, which causes the action described with reference to FIG. 4. Similarly, the touchpad 107 can be used to lock the lid 104 by pressing the lock button 114 on the touchpad 107, which causes the action described above with reference to FIG. 3.

A keyhole 116 is also provided on the touchpad 107 that can also be used to lock and unlock the lid 104.

The tamper resistant parcel delivery box 100 also includes a tamper resistant feature that prevents the locking interface 106 from being operated when the lid 104 is open. This is a significant improvement in that it prevents a thief from tampering with the locking sequence described above with reference to FIG. 3. In particular, a thief may attempt to open the lid 104, which would be unlocked when the container 102 is empty, and press the lock button 114. If the lock button 114 is pressed when the lid 104 is open, this would prevent the lid 104 from being locked when a package is placed in the container 102 because the first end 125 of the locking bar 120 would already be moved in the second direction 127 and unable to slide within the catch 130.

In order to prevent the locking interface 106 from being operated when the lid 104 is open, a tamper prevention circuit 134 may be carried by the container 102 and be configured to detect when the lid 104 is in an open position. Generally speaking, when the lid 104 is open, the tamper prevention circuit 134 is also open so that the locking interface 106 is not powered. Likewise, when the lid 104 is closed, the tamper prevention circuit 134 is closed and the locking interface 106 is powered.

Figure 5:
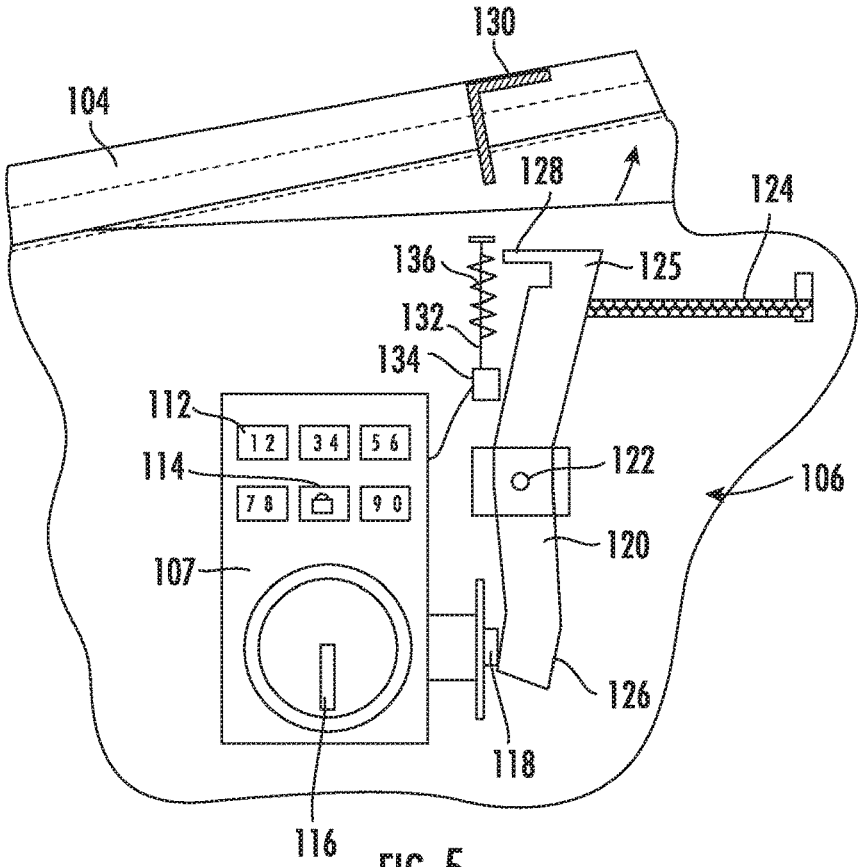
FIG. 5 is a cutaway view of the locking interface with the locking bar in an unlocked position and a lid of the box in an open position.
Figure 6:
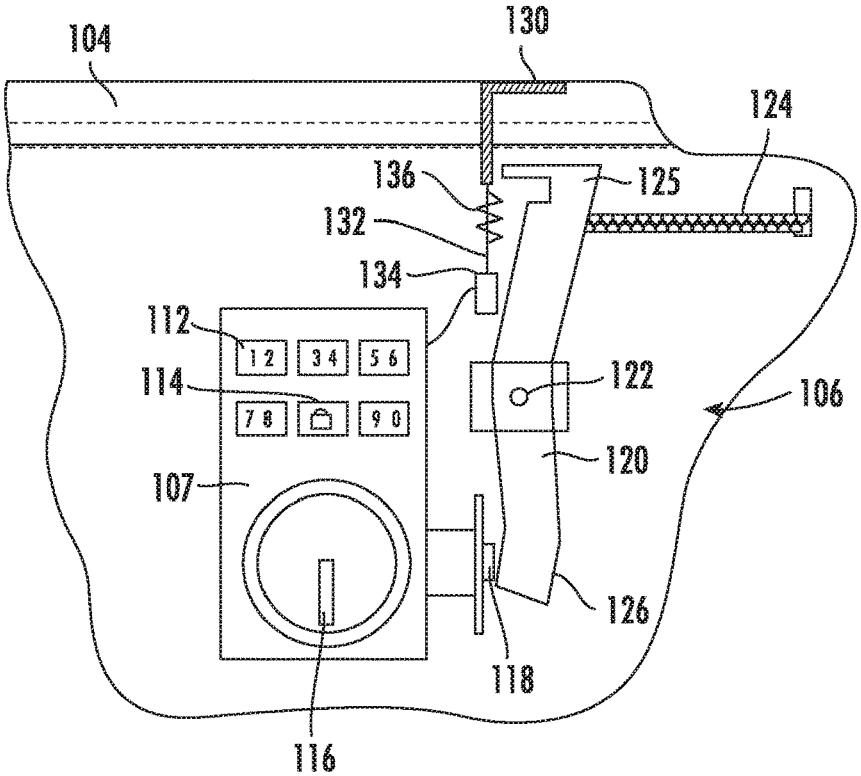
FIG. 6 is a cutaway view of the locking interface with the locking bar in an unlocked position and the lid in a closed position.

In particular, a plunger rod 132 is secured to the container 102 and has a first end 136 positioned below the underside of the lid 104 as illustrated in FIGS. 5 and 6. The tamper prevention circuit 134 is coupled to the locking interface 106 and is configured to power the locking interface 106 in response to a downward position of the plunger rod 132 when the lid 104 is closed. The tamper prevention circuit 134 (see FIGS. 9 and 10) is configured to selectively prevent the locking interface 106 from actuating the retractable deadbolt 118 when the lid 104 is open.

For example, the lid 104 is open in FIG. 5. Accordingly, the first end 136 of the plunger rod 132 extends upward as the lid 104 is lifted upwards and may be spring loaded. The tamper prevention circuit 134 in cooperation with the plunger rod 132 detects that lid 104 is open due to the upward position of the plunger rod 132 and prevents the locking interface 106 from actuating the retractable deadbolt 118 because the tamper prevention circuit 134 is in an open circuit condition and no power goes to the locking interface 106. As can be appreciated by those of ordinary skill in the art, there are different methods of detecting the position of the plunger rod 132 and causing the locking interface 106 to be unable to actuate the retractable deadbolt 118.

As the lid 104 is closed over the container 102, the catch 130 (or the lid 104 itself, for example) pushes the plunger rod 132 to a downward position as shown in FIG. 6. The tamper prevention circuit 134 is configured to detect that the lid 104 is now closed based on the downward position of the plunger rod 132 and the tamper prevention circuit 134 is in a closed circuit condition that powers the locking interface 106.

Figure 7:
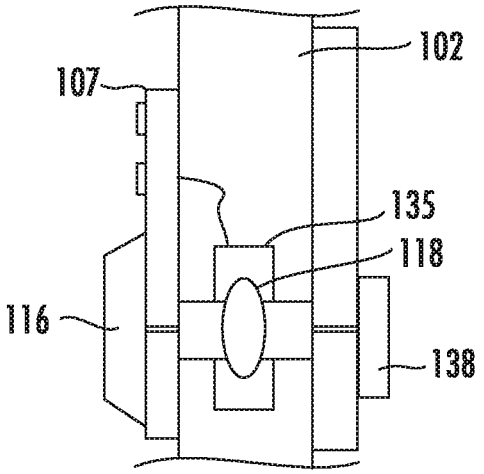
FIG. 7 is a partial sectional view of the locking assembly.

A partial sectional view of the locking interface 106 is illustrated in FIG. 7. The touchpad 107 is mounted on an exterior surface of the container 102 and is coupled to an electronic driver 135 used to extend and retract the deadbolt 118 automatically. On a lower portion of the touchpad 107 is a keyhole 116 that can be used to manually extend and retract the deadbolt 118.

Figure 8:
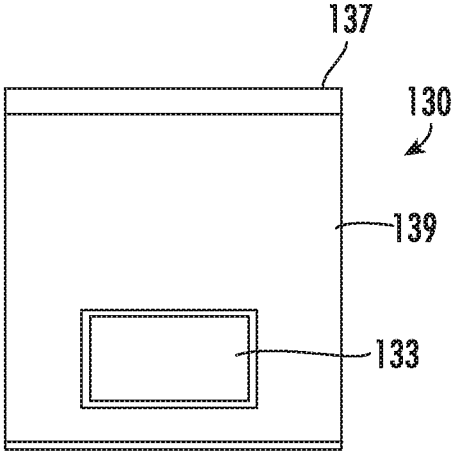
FIG. 8 is a front view of a catch for locking the locking bar.

The catch 130 is illustrated in FIG. 8 and includes a horizontal plate 137 used to secure to the underside of the lid 104. An adjoining vertical plate 139 hangs downward perpendicular from the horizontal plate 137 to form an "L" shaped bracket. In addition, within the vertical plate 139 of the catch 130 is an aperture 133. The aperture 133 is sized and positioned to receive the beak 128 of the first end 125 of the locking bar 120 therethrough.

Figure 9:
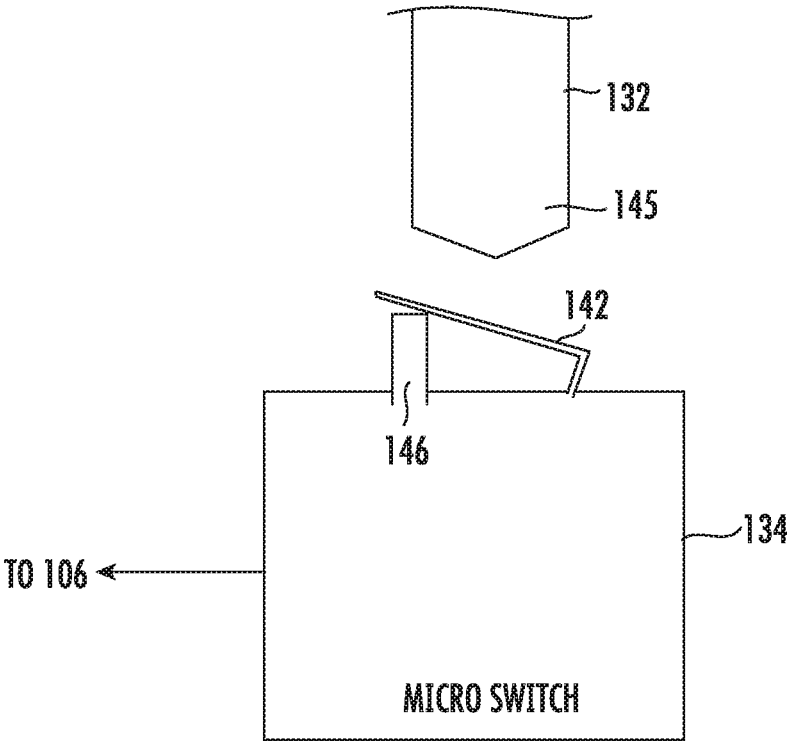
FIG. 9 is a schematic diagram of a plunger rod when the lid is open.
Figure 10:
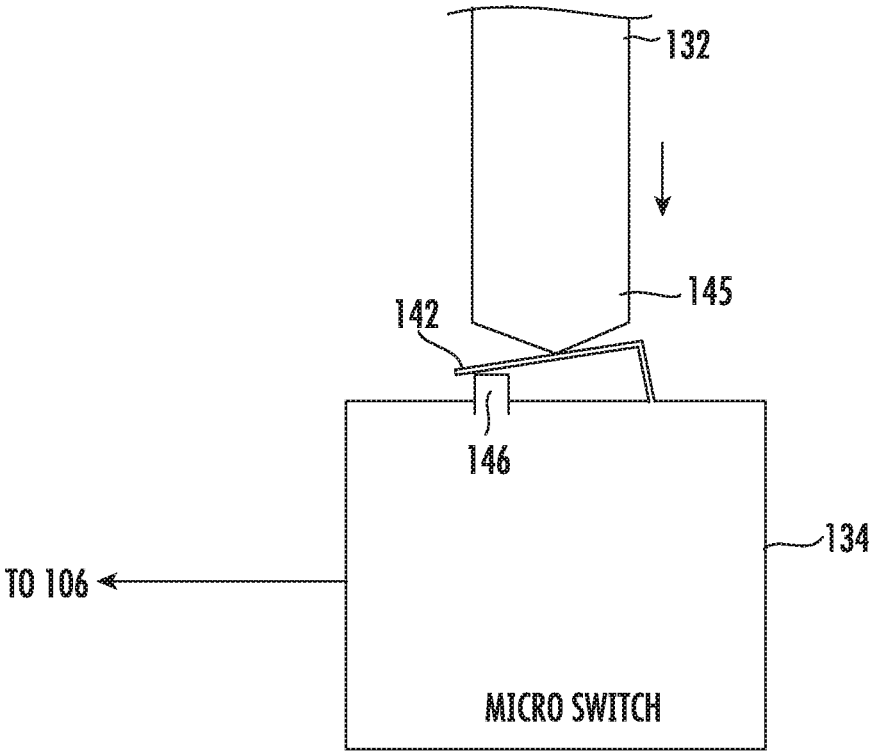
FIG. 10 is a schematic diagram of the plunger rod in a downward position in order to close a tamper prevention circuit.

Referring now to FIGS. 9 and 10, a particular aspect of the tamper prevention circuit 134 is illustrated in more detail. For example, in FIG. 9 the plunger rod 132 is in the upward position indicating that the lid 104 is open. The plunger rod 132 is aligned to slide down towards the tamper prevention circuit 134 when the lid 104 is closed. As can be appreciated by those of ordinary skill in the art, the tamper prevention circuit 134 may be one of many different types of switches such as a micro switch that includes an actuator arm 142 and positioned under the plunger rod 132. When the actuator arm 142 is in a resting state as shown in FIG. 9, the circuit is in an open condition and the locking interface 106 is not powered. The push button 146 of the tamper prevention circuit 134 is activated when the plunger rod 132 moves downward and presses the actuator arm 142 downward as shown in in FIG. 10. As a result of the actuator arm 142 being pushed down by the plunger rod 132, the push button 146 moves downward to close the circuit and the locking interface 106 is now powered.

In another particular aspect, the tamper prevention circuit 134 may comprise a magnetic switch as those of ordinary skill in the art can appreciate. The magnetic switch is similarly operated by closing the lid 104 which causes the plunger rod 132 to move downward and close the circuit of the tamper prevention circuit 134.

In a particular aspect, the locking interface 106 is prevented from actuating the retractable deadbolt 118 when the tamper prevention circuit 134 is in an open circuit condition and indicating the lid 104 is open as shown in FIG. 9. The open circuit condition of the tamper resistant circuit 134 renders the locking interface unable to actuate the retractable deadbolt 118.

In response to the lid 104 being closed as shown in FIG. 10, the tamper prevention circuit 134 has a closed circuit condition. Accordingly, when the tamper prevention circuit 134 is in the closed circuit condition then the locking interface 134 is placed in a normal operating condition.

As explained above, the tamper prevention circuit 134 prevents a thief from pressing the lock button 114 while the lid 104 is open, and which would prevent the lid 104 from locking when a parcel is placed in the container 102.

In operation, a code (or key) is entered into the locking interface 106 to retract a deadbolt 118 causing the first end 125 of the locking bar 120 to release the catch 130 for the lid 104 in order to be placed in an unlocked condition. The lid 104 to the container 102 can then be opened when the lid 104 is in the unlocked condition. If there is a parcel in the container 102, then it can be removed. If there is no parcel in the container 102, then the container 102 remains unlocked and is ready to accept a parcel.

Accordingly, the container 102 remains empty and unlocked until a delivery person places a parcel within the container 102 and closes the lid 104. When the delivery person presses the lock button 114, for example, on the locking interface 106, the tamper prevention circuit 134 detects that the lid 104 is not open by its closed circuit condition and the locking interface 106 is therefore powered and able to extend the retractable deadbolt 118 causing the first end 125 of the locking bar 120 to once again engage the catch 130 and lock the lid 104.

Figure 11:
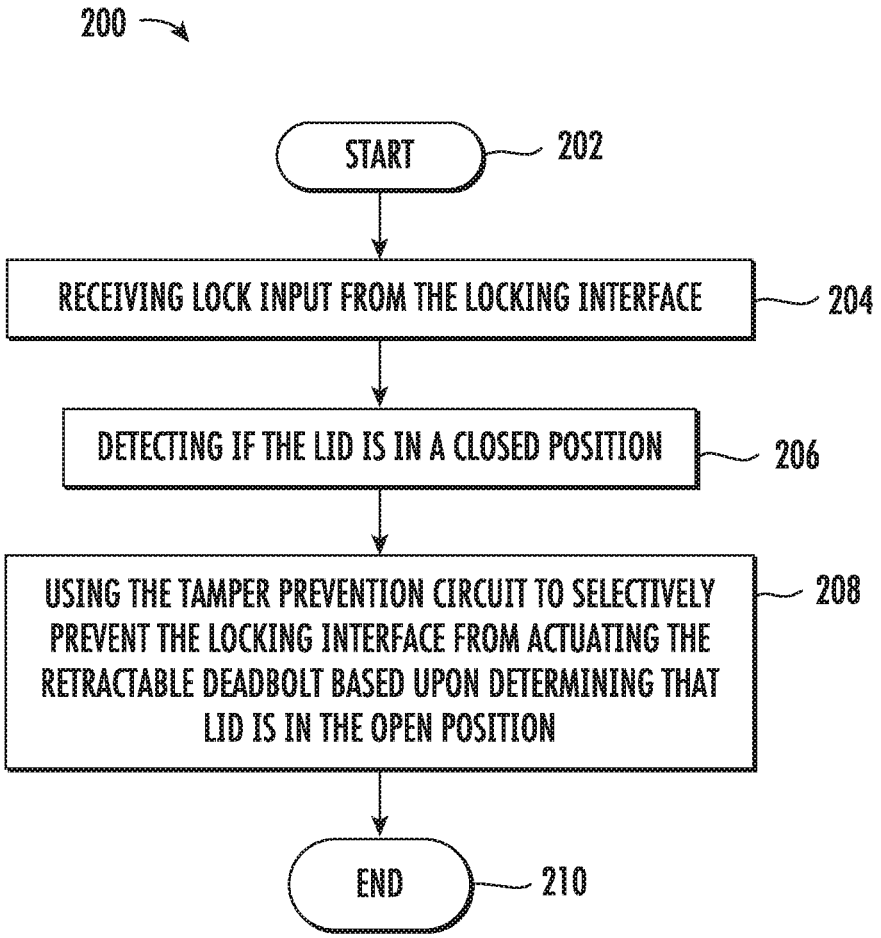
FIG. 11 is a flowchart illustrating a method for operating the tamper resistant parcel delivery box illustrated in FIG. 1.

Referring now to the flowchart 200 in FIG. 11, and generally speaking, a method of operating the tamper resistant parcel delivery box illustrated in FIGS. 1-10 will be discussed.

From the start, at 202, the method includes receiving lock input from the locking interface, at 204, and detecting if the lid is in an open position, at 206. Moving to 208, the method includes using the tamper prevention circuit to selectively prevent the locking interface from actuating the retractable deadbolt based upon determining that the lid is in the open position. The method ends, at 210.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A tamper resistant parcel delivery box comprising:

a container having a top periphery edge and an interior volume configured to receive packages therein;

a hinge positioned along the top periphery edge of the container;

a lid secured to the container via the hinge;

a locking interface secured to the container and having a retractable deadbolt;

a locking bar having a first end and a second end, the second end cooperating with the retractable deadbolt;

a catch secured to an underside of the lid to lock the first end of the locking bar upon actuation of the retractable deadbolt; and a tamper prevention circuit configured to selectively prevent the locking interface from actuating the retractable deadbolt when the lid is open.

2. The tamper resistant parcel delivery claim 1, further comprising a plunger rod secured to the container and having a first end positioned below the underside of the lid and configured to activate the tamper prevention circuit in response to a downward position of the plunger rod when the lid is closed.

3. The tamper resistant parcel delivery box of claim 2, wherein the plunger rod is positioned to slide down towards the tamper prevention circuit in response to movement of the lid.

4. The tamper resistant parcel delivery claim 3, wherein the tamper prevention circuit is configured to prevent the locking interface from actuating the retractable deadbolt when the tamper prevention circuit is in an open circuit condition indicating the lid is open.

5. The tamper resistant parcel delivery claim 1, wherein the first end of the locking bar has a notch and a beak extending over the notch to engage the catch.

6. The tamper resistant parcel delivery claim 1, further comprising a locking bar spring secured to the locking bar and biasing the locking bar in a first direction.

7. The tamper resistant parcel delivery claim 1, wherein the locking interface has a touchpad.

8. The tamper resistant parcel delivery claim 1, wherein the tamper prevention circuit comprises a micro switch.

9. The tamper resistant parcel delivery claim 8, wherein the tamper prevention circuit comprises a magnetic switch.

10. The tamper resistant parcel delivery box of claim 1, wherein the locking bar has a pivot pin positioned at a midpoint in order for the locking bar to alternate between moving the first end in a first direction and the second end moving in an opposing second direction.

11. The tamper resistant parcel delivery claim 1, further comprising a power source coupled to the locking interface and the tamper prevention circuit.

12. The tamper resistant parcel delivery claim 1, wherein the container has a slot formed therein and is configured to pass mail to the interior volume of the container.

13. The tamper resistant parcel delivery claim 1, wherein the locking interface has a keyhole.

14. A tamper resistant parcel delivery box comprising:

a container configured to receive packages therein;

a hinge;

a lid secured to the container via the hinge;

a locking interface secured to the container and having a retractable deadbolt;

a locking bar having a first end and a second end, the second end cooperating with the retractable deadbolt;

a catch secured to an underside of the lid to engage the first end of the locking bar when the retractable deadbolt is activated; and a tamper prevention circuit coupled to the locking interface and configured to selectively prevent the locking interface from actuating the retractable deadbolt when the lid is in an open position.

15. The tamper resistant parcel delivery box of claim 14, further comprising a plunger rod secured to the container and having a first end positioned below the underside of the lid, and the plunger rod configured to activate the tamper prevention circuit when moved in a downward position when the lid is closed.

16. The tamper resistant parcel delivery box of claim 14, wherein the first end of the locking bar having a notch and a beak extending over the notch to engage the catch.

17. The tamper resistant parcel delivery box of claim 14, further comprising a locking bar spring secured to the locking bar and biasing the locking bar in a first direction.

18. The tamper resistant parcel delivery box of claim 14, wherein the locking interface has a touchpad.

19. The tamper resistant parcel delivery box of claim 14, wherein the tamper resistant circuit comprises a micro switch activated by the plunger rod.

20. A method of operating a tamper resistant parcel delivery box comprising a container, a hinge, a lid secured to the container via the hinge, a locking interface secured to the container and having a retractable deadbolt, a locking bar having a first end and a second end cooperating with the retractable deadbolt, a catch secured to an underside of the lid to lock the first end of the locking bar to the lid, and a tamper prevention circuit configured to selectively prevent the locking interface from actuating the retractable deadbolt, the method comprising:

receiving lock input from the locking interface;

detecting if the lid is in an open position based upon the tamper prevention circuit; and using the tamper prevention circuit to selectively prevent the locking interface from actuating the retractable deadbolt based upon determining that the lid is in the open position.

* * * * *